United States Patent [19]

Quinn

[11] 4,180,174

[45] Dec. 25, 1979

[54] CHILD-RESISTANT CLOSURE

[75] Inventor: David R. Quinn, Pembroke Pines, Fla.

[73] Assignee: The AFA Corporation, Miami Lakes, Fla.

[21] Appl. No.: 961,356

[22] Filed: Nov. 16, 1978

[51] Int. Cl.[2] ..... B65D 55/02; B65D 85/56; H61H 1/00

[52] U.S. Cl. ..... 215/221; 215/217

[58] Field of Search ..... 215/216, 217, 218, 221

[56] References Cited

U.S. PATENT DOCUMENTS

| | | | |
|---|---|---|---|
| 3,399,796 | 9/1968 | Steiner | 215/216 |
| 3,514,003 | 5/1970 | Fitzgerald | 215/221 |

*Primary Examiner*—George T. Hall

*Attorney, Agent, or Firm*—Stanley A. Marcus; William R. Wright, Jr.

[57] ABSTRACT

A child-resistant threaded closure for containers is presented which includes a lower ring-like portion attached to the closure by retractable and extendible legs and having a matching thread. With the closure screwed in place on a container, the ring is pushed down by means of tabs to a position below the last thread on the container with the legs extended whereupon, when an attempt is made to unscrew the closure, the thread segment of the ring interferes with the last thread of the container and prevents its removal. For the closure to be removed, the ring is lifted up by finger pressure applied to the tabs until the legs are fully retracted and the threads match up with the others after which action the closure can be unscrewed.

11 Claims, 6 Drawing Figures

CHILD-RESISTANT CLOSURE

BACKGROUND OF THE INVENTION AND DISCUSSION OF THE PRIOR ART

Attempts have been made recently, for safety reasons, to provide closures for containers which make it difficult for small children to remove the closures to gain access to the containers and to their possibly harmful contents. All of these suffer, however, in some degree from the problem that it may be too easy for the child to remove the closure and too difficult for many adults to do so. Also, they tend to be difficult to make and therefore become expensive because of their complicated form. Furthermore, many often require modification of the container itself which is not desirable.

The present invention solves these problems by presenting a closure which does not require modification of the container to which it is to be attached, is not difficult for an adult to use, is simple in construction and should be relatively inexpensive to manufacture.

A U.S. patent on an invention which attempts to solve these problems was issued to Maurice Steiner under Ser. No. 3,399,769 on Sept. 3, 1968 and shows, as part of its disclosure, two parts of the sidewall of the closure which can be distorted upwardly to bring into alignment portions of the thread on the inside of the closure so that the closure can be unscrewed from a container. This arrangement differs from the device shown in the present invention in a number of important respects such as, for instance, the fact that the partial thread of the present invention is not deformed nor distorted in any way. Furthermore, alignment of the partial thread is completely automatic in the present invention whereas in the Steiner showing the operator, or installer of the closure, must bend the thread portion upward and aim the thread into position.

Other differences exist as well and will become apparent from the description and claims concerning the present invention which follow in this application.

OBJECTS OF THE INVENTION

It is , therefore, an object of the present invention to provide a closure for a container wherein the closure is resistant to removal by small children and yet is easily removable by an adult instructed in its proper removal procedures.

It is also an object of the present invention to provide a closure of the foregoing type wherein a movable thread portion is automatically matched to a corresponding thread on the closure when the thread portion is moved into position for removal of the closure.

It is also an object of the present invention to provide a closure of the foregoing type wherein the movable thread portion is neither bent nor distorted at any time.

It is also an object of the present invention to provide a closure of the foregoing type wherein a locking means is included and the locking means is unitary with the closure and therefore cannot be lost nor separated from the closure.

It is also an object of the present invention to provide a closure of the foregoing type which can be used more than once since it is not torn nor destroyed during its normal use cycle.

Other objects and advantages of the present invention will become apparent from the detailed description and claims which follow. In the drawings:

DETAILED DESCRIPTION AND OPERATION OF THE INVENTION

Figure 1:
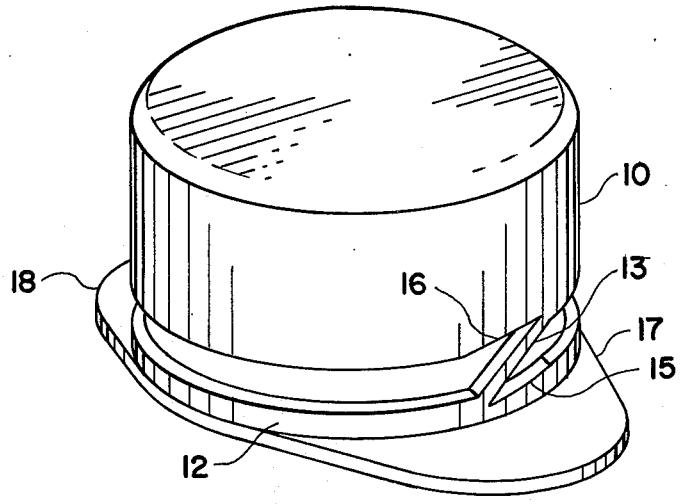
FIG. 1 is a perspective view of the closure with its locking ring in its extended position.
Figure 2:
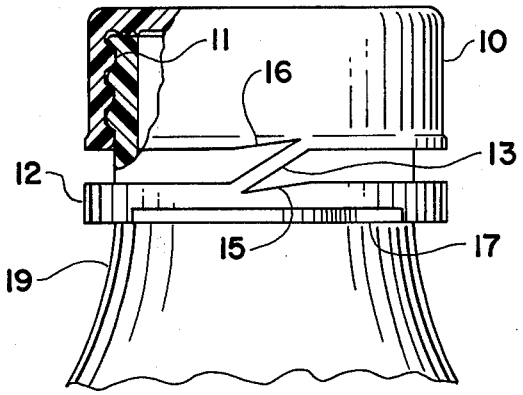
FIG. 2 is a side elevational partially cutaway view of the closure in place on a container and with the locking ring in its extended position.
Figure 3:
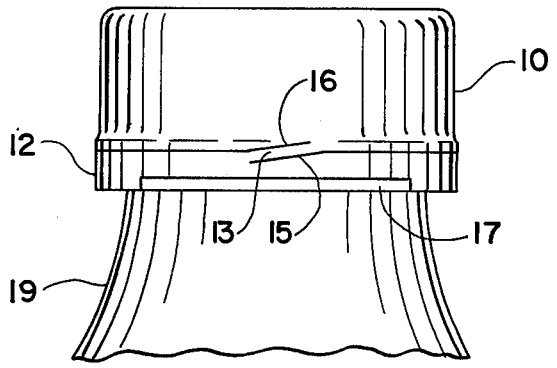
FIG. 3 is a side elevational view of the exterior of the closure in place on a container and with the locking ring in its retracted position.

In a preferred embodiment of the present invention and with particular reference to FIGS. 1 and 2 of the drawings, a closure or cap 10 is shown having a closed top and substantially cylindrical sides, and, is equipped with standard threads 11 adapted tp be screwed on a container 19 having corresponding threads. The lower portion of the cap 10, however, is in the form of a separate ring 12 attached to the cap 10 by retractable and extendible hinged links 13, 14 which allow it to be moved up and down in substantially parallel relationship with respect to the cap and also with a slight rotary motion brought about by the action of the links 13, 14 as the ring 12 is moved up and down. Also, ring 12 is so formed on its inner periphery that it completes the final thread of the cap 10 when ring 12 is in its "up" or retracted position flat against the underside of cap 10. When it is in its "down" or extended position, however, this final thread portion is not aligned with the other threads of the cap 10 and thus will jam the threads of the container if removal of the closure 10 is attempted.

Figure 4:
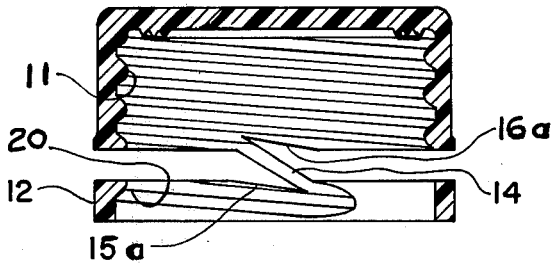
FIG. 4 is a side elevation of the closure in crosssection with the locking ring in its extended position and showing the matching thread portions on the closure and ring.
Figure 6:
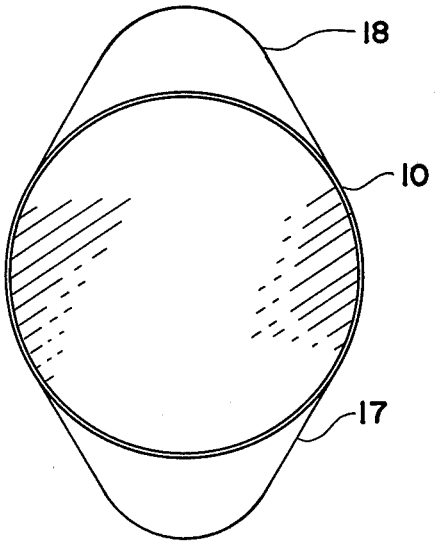
FIG. 6 is a top external view of the closure showing its lifting and depressing tabs.
Figure 5:
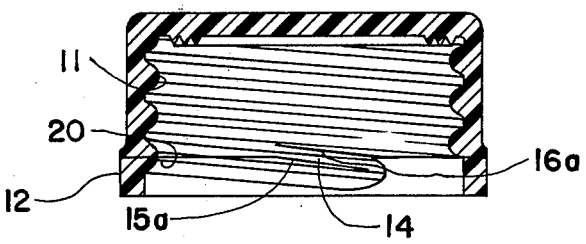
FIG. 5 is a view similar to that of FIG. 4 except that the locking ring is in its retracted position and the thread portions are shown matched and aligned.

The final thread portion or segment designated by numeral 20 in FIG. 4 is formed as a full thread which has been cut off flush with the upper surface of ring 12. Similarly, the thread 11 on the inner periphery of the upper portion of the cap 10 terminates at the bottom of the cap 10 in a "cut off" or flat surface flush with the lower rim of cap 10 as shown in FIG. 4 and is adapted to match the "cut off" or partial thread 20 of ring 12 so that when they are brought together in matching relationship a fully formed thread is established as shown in FIG. 5. It is important to note that the thread on the inner periphery of the upper portion of the cap 10 is made longer than the corresponding thread of the container so that the "cut off" partial thread portion or segment 20 on the ring 12 is completely below the last thread of the container 19 when the cap 10 is screwed down all the way with its top against the rim of container 19. The "cut off" thread portion 20 on the ring 12 is thus free of contact with the container thread and permits the ring 12 to be moved downward and upward freely.

The aforementioned links 13, 14 are molded integrally with both the cap 10 and the ring 12 and are slender in form so that their attachment points to both the cap 10 and ring 12 act as "living hinges", i.e. they bend at those points and thus act as hinges although they are integral with the members to which they are attached. In addition, one half of each link fits into a sloping recess 15 or 15*a* in the ring 12 and a corresponding similar recess 16 or 16*a* in cap 10 until each of the links 13, 14 in no way interfere with the full upward position of the ring 12 as ring 12 bears in full contact with cap 10.

Tabs 17, 18 are provided on ring 12 in the area or vicinity of the links 13, 14 and extend outwardly therefrom in the manner shown in FIGS. 1 and 5. Tabs 17, 18 are preferably formed integrally with ring 12 and are made relatively stiff so that an upward and downward force may be applied to them by the fingers of the user of the cap 10.

In operation, with the cap 10 off the container, the ring 12 is first pushed up against cap 10 and held there until the cap 10 is threaded in place on the container 19. It is to be noted that ring 12 stays in place against cap 10 throughout the screwing on of cap 10 with the thread of ring 12 acting as the lower thread of the cap 10 as though it was one piece with the remaining thread. When the cap 10 has been screwed in place in the normal manner, the tabs 17, 18 are depressed by the fingers of the user until ring 12 is well below the lower periphery of cap 10 and well below the last thread of cap 10.

The cap 10 is now installed and it will be seen that any attempt to unscrew cap 10 without particular realignment of the partial thread of ring 12 with those of cap 10 will result in jamming of ring 12's thread and interference with removal of the cap 10 in the usual single motion, i.e. unscrewing of the cap 10. Instead, removal of the cap 10 cannot be made without the action of two distinct motions not normally made by a child who may be attempting to open the container 19 by removing the cap. The first of these required actions or motions is an upward pull or lift on tabs 17, 18 with the fingers until ring 12 seats on the bottom periphery of cap 10 and the ring 12's "cut off" thread segment automatically becomes aligned with the "cut off" thread of cap 10. Ring 12 is then held in place there while the cap 10 is rotated to unscrew it. The "cut off" thread portions then act as a whole thread and permit cap 10 to be unscrewed and removed. Once the "cut off" or split thread becomes mated with the ordinary threads of the container, there is no need to continue to exert an upward force on the tabs 17, 18 since ring 12 will then be held up in position automatically by the thread of the container.

From the foregoing, it will be seen that a first unnatural motion is required to position ring 12 followed by a normal unscrewing action. It is this feature which gives the present invention its child-resistant qualities since it is expected that most small children would not be able to accomplish both motions in that sequence to remove the cap.

While there have been shown and described and pointed out the fundamental novel features of the invention as applied to a preferred embodiment, it will be understood that various omissions and substitutions and changes in the form and details of the device illustrated and in its operation may be made by those skilled in the art, without departing from the spirit of the invention. It is the intention, therefore to be limited only as indicated by the scope of the following claims.

What is claimed is:

1. A child-resistant closure for closing a necked container with a screw thread formed on the neck, said closure including a top and a sidewall with the sidewall having an internal screw thread adapted to engage the screw thread of the container neck, said internal screw thread cut off at the lower edge of said sidewall in a plane perpendicular to the longitudinal central axis of the closure and a screw thread segment adapted to match said cut off thread and to move selectively from a matched first position to a second position away from but in parallel relationship to the cut off thread.

2. A child-resistant closure for closing a necked container with a screw thread formed on said neck, said closure including a top and an annular sidewall having an internal screw thread adapted to engage the screw thread of the container neck, an annular ring encircling said neck and having an internal wall including a thread segment, retractable and extendible means attaching said ring to said cap, and said ring movable from a retracted position with said thread segment aligned with the thread of the cap to an extended position with the thread out of alignment with the thread of the cap.

3. The invention set forth in claim 2 with the retractable and extendible means comprising at least one link member hingedly affixed at one end to the cap and at its other end to the ring.

4. The invention set forth in claim 3 wherein the hinges are living hinges integral with the cap and the ring.

5. The invention set forth in claim 3 with a recess in the closure adapted to receive one half of at least one link member.

6. The invention set forth in claim 3 with at least one recess in the ring sufficiently large to receive one half of at least one link member.

7. The invention set forth in claim 3 with a recess in both the closure wall and the ring with each sufficiently large to receive one half of a link and altogether large enough to receive a whole link.

8. The invention set forth in claim 2 with at least one outwardly extended tab on the ring.

9. The invention set forth in claim 2 with a plurality of outwardly extending tabs on the ring and spaced about its exterior.

10. The invention set forth in claim 9 with two outwardly extended tabs on the ring and disposed on opposite sides thereof.

11. The invention set forth in claim 9 with the tabs each located on the ring's exterior in the vicinity of a link.

* * * * *

UNITED STATES PATENT OFFICE

CERTIFICATE OF CORRECTION

Patent No. 4,180,174 Dated December 25, 1979

Inventor(s) David R. Quinn

It is certified that error appears in the above-identified patent and that said Letters Patent are hereby corrected as shown below:

Column 1, line 24, change patent number "3,399,769" to --3,399,796--;

Column 2, line 25, change "tp" to --to--.

Signed and Sealed this

*Twenty-fifth* Day of *March 1980*

[SEAL]

*Attest:*

SIDNEY A. DIAMOND

*Attesting Officer*

*Commissioner of Patents and Trademarks*